US009885455B2

(12) United States Patent
Yamamoto et al.

(10) Patent No.: US 9,885,455 B2
(45) Date of Patent: Feb. 6, 2018

(54) VEHICLE LAMP

(71) Applicant: Koito Manufacturing Co., Ltd., Tokyo (JP)

(72) Inventors: Ippei Yamamoto, Shizuoka (JP); Tatsuhiko Harada, Shizuoka (JP); Yuji Yasuda, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 91 days.

(21) Appl. No.: 15/147,041

(22) Filed: May 5, 2016

(65) Prior Publication Data

US 2016/0356447 A1 Dec. 8, 2016

(30) Foreign Application Priority Data

Jun. 3, 2015 (JP) ..... 2015-113231

(51) Int. Cl.
*F21S 8/10* (2006.01)

(52) U.S. Cl.
CPC ..... *F21S 48/328* (2013.01); *F21S 48/115* (2013.01); *F21S 48/1305* (2013.01)

(58) Field of Classification Search
CPC ..... F21S 48/328; F21S 48/115; F21S 48/145; F21S 48/1305; F21S 48/1159; F21S 48/1388; F21S 48/1233; F21Y 2101/02; F21V 29/505; F21V 29/503; F21V 7/10; F21V 17/06; F21V 16/10; F21V 16/12; F21V 19/0055; H01L 33/64
USPC ..... 362/509, 516
See application file for complete search history.

(56) References Cited

U.S. PATENT DOCUMENTS 8,523,416 B2 * 9/2013 Ohmi ..... F21S 48/1104 315/82

FOREIGN PATENT DOCUMENTS

JP 2015-046235 A 3/2015

* cited by examiner

*Primary Examiner* — Jong-Suk (James) Lee
*Assistant Examiner* — Mark Tsidulko
(74) *Attorney, Agent, or Firm* — Abelman, Frayne & Schwab

(57) ABSTRACT

The vehicle lamp of the present disclosure includes a substrate, a heat dissipating member, a reflector, and a fastening member. The reflector includes a boss portion that protrudes toward the heat dissipating member side and includes a fastening hole. The substrate includes a first opening. The heat dissipating member is in contact with the substrate to be thermally conductive with the substrate and includes a first portion that includes a second opening, a second portion that is more spaced apart from the reflector than the first portion to include an insertion hole and a fastening seat surface, and a connecting portion that connects the first portion and the second portion to each other. The boss portion passes through the first opening and the second opening and abuts to the second portion such that the fastening hole and the insertion hole overlap with each other.

2 Claims, 3 Drawing Sheets

VEHICLE LAMP

CROSS-REFERENCE TO RELATED APPLICATIONS

This application is based on and claims priority from Japanese Patent Application No. 2015-113231 filed on Jun. 3, 2015, with the Japan Patent Office, the disclosure of which is incorporated herein in its entirety by reference.

TECHNICAL FIELD

The present disclosure relates to a vehicle lamp. In particular, the present disclosure relates to a vehicle lamp used for vehicles such as, for example, cars.

BACKGROUND

A vehicle lamp conventionally known in the related art includes a substrate mounted with a light emitting diode (LED) thereon as a light source, a heat dissipating plate disposed on a surface of the substrate at a side opposite to the light source mounting surface, and a reflector disposed at the light source mounting surface side of the substrate (see, e.g., Japanese Patent Laid-Open Publication No. 2015-046235).

SUMMARY

In the vehicle lamp having the above-described structure, the substrate, the heat dissipating plate, and the reflector are generally fixed to each other by fastening members such as, for example, screws. Through repeated intensive studies on a vehicle lamp, the inventors of the present disclosure have come to recognize that a light quantity of a vehicle lamp may be reduced due to the fastening structure of the substrate, the heat dissipating plate, and the reflector in the conventional vehicle lamp.

The present disclosure has been made in consideration of such a situation, and an object thereof is to provide a technology of increasing a light quantity of a vehicle lamp.

In order to solve the above-described problem, an aspect of the present disclosure provides a vehicle lamp. The vehicle lamp includes a substrate having a light source mounting surface, a heat dissipating member disposed on a surface of the substrate at a side opposite to the light source mounting surface, a reflector disposed at the light source mounting surface side of the substrate to reflect light emitted from a light source mounted on the light source mounting surface, and a fastening member configured to fix the substrate, the heat dissipating member, and the reflector to each other. The reflector includes a boss portion that protrudes toward the heat dissipating member side and includes a fastening hole for the fastening member. The substrate includes a first opening in an area overlapping with the boss portion in the stacking direction of the reflector, the substrate, and the heat dissipating member. The heat dissipating member is in contact with the substrate to be thermally conductive with the substrate and includes a first portion that includes a second opening in an area overlapping with the boss portion in the stacking direction, a second portion that overlaps with the second opening in the stacking direction and is more spaced apart from the reflector than the first portion to include an insertion hole for the fastening member and a fastening seat surface, and a connecting portion that connects the first portion and the second portion to each other. The boss portion passes through the first opening and the second opening and abuts to the second portion such that the fastening hole and the insertion hole overlap with each other in the stacking direction. According to this aspect, a light quantity of a vehicle lamp may be increased.

In the above-described aspect, the heat dissipating member may include a small width portion having a relatively small width and a large width portion having a relatively large width in an area ranging from the end of the connecting portion which is in contact with the first portion to the insertion hole of the second portion. Accordingly, the stress generated by the fastening of the fastening member may be absorbed by the small width portion.

According to the present disclosure, a light quantity of a vehicle lamp may be increased.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Hereinafter, preferred exemplary embodiments of the present disclosure will be described with reference to the accompanying drawings. Identical or corresponding components, members, and processes in each of the drawings will be denoted by the same symbols, and overlapping descriptions thereof will be appropriately omitted. Further, the exemplary embodiments are not intended to limit the present disclosure thereto, but are merely exemplary. All features described in the exemplary embodiments or combinations thereof may not be essential for the present disclosure. In addition, for example, the terms "first" and "second" used herein or the claims are not intended to refer to any order or importance but are intended to discriminate a component from another component.

Figure 1:
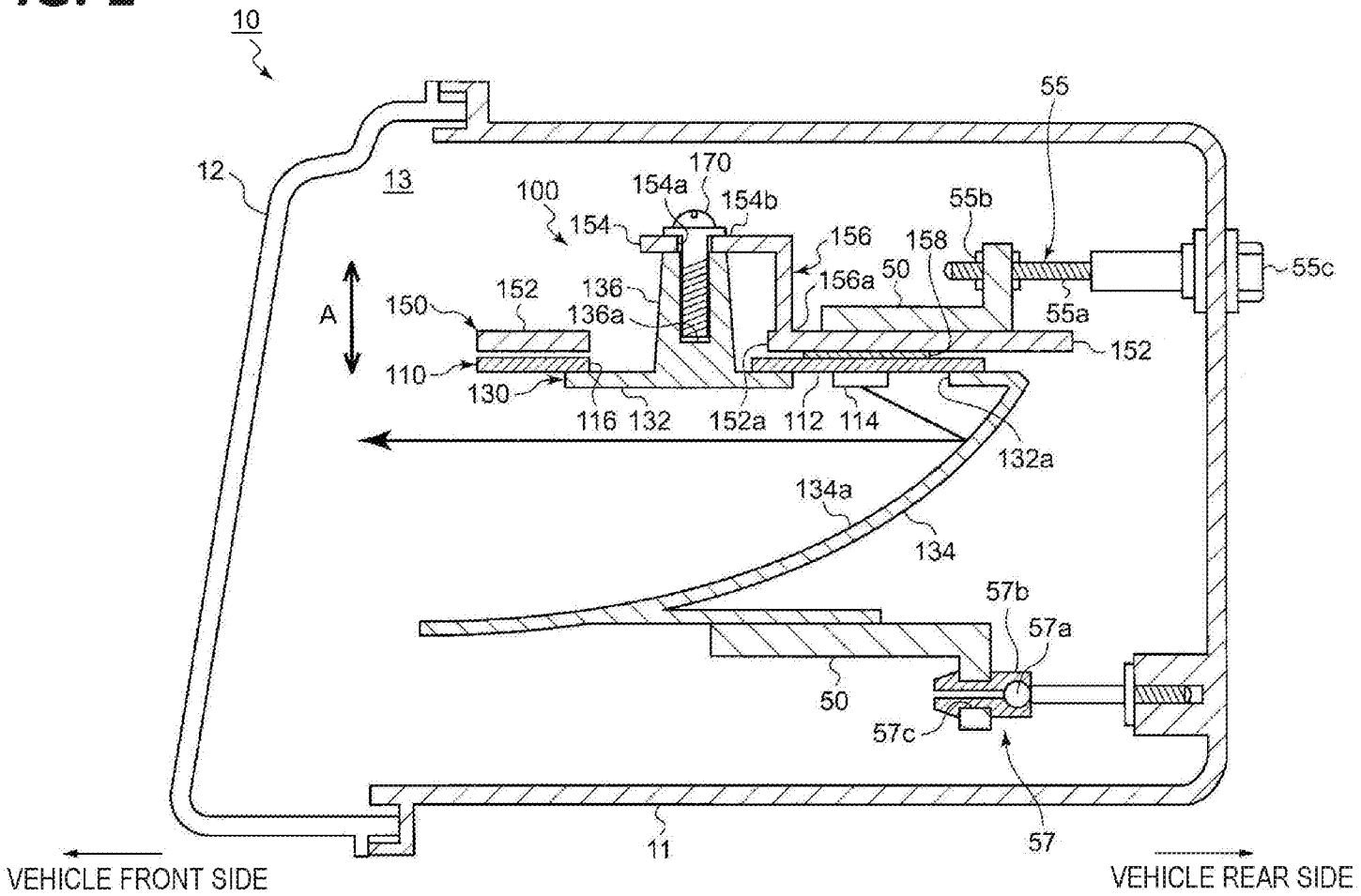
FIG. 1 is a cross-sectional view schematically illustrating a structure of a headlamp device including a vehicle lamp according to an exemplary embodiment.
Figure 2:
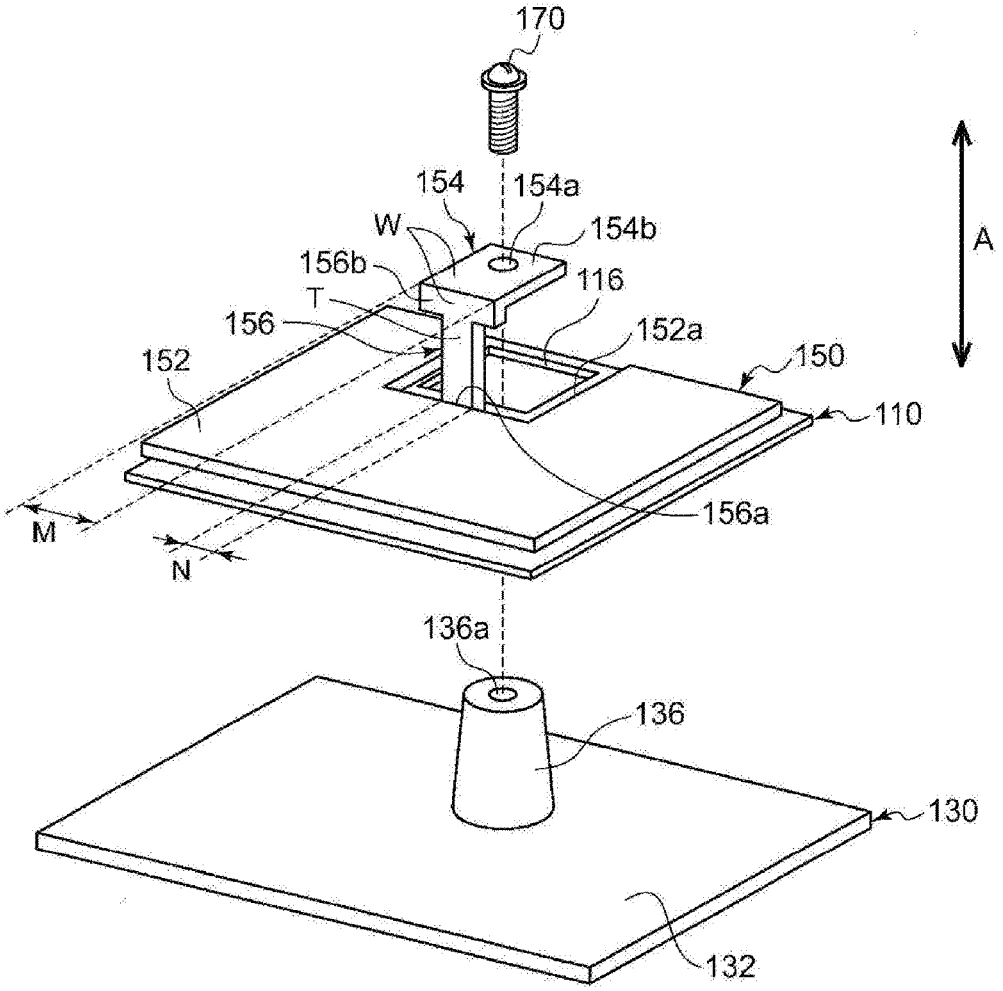
FIG. 2 is a view for describing an assembly structure of the vehicle lamp in the exemplary embodiment.

FIG. 1 is a cross-sectional view schematically illustrating a structure of a headlamp device including a vehicle lamp according to an exemplary embodiment. FIG. 2 is a view for describing an assembly structure of the vehicle lamp in the exemplary embodiment. In addition, a scale or a shape of each component illustrated in each of the drawings is conveniently set in order to facilitate descriptions thereof and should not be construed as being limited.

A lamp unit 100 as a vehicle lamp according to an exemplary embodiment is mounted in, for example, a headlamp device 10. The headlamp device 10 includes a pair of headlamp units which are disposed at the front left and right sides of a vehicle, respectively. The pair of headlamp units has a substantially identical configuration, except that the structures thereof are bilaterally symmetrical to each other. Thus, FIG. 1 illustrates a structure of one of the pair of headlamp units as the headlamp device 10.

The headlamp device 10 includes a lamp body 11 and a transparent external cover 12 that covers a front opening of the lamp body 11. The lamp body 11 and the external cover 12 form a lamp chamber 13. The lamp unit 100 as a vehicle lamp is accommodated within the lamp chamber 13. The lamp unit 100 is configured to illuminate at least one of, for example, a high beam light distribution pattern and a low beam light distribution pattern.

The lamp unit 100 is supported to the lamp body 11 by a bracket 50. The bracket 50 is formed of, for example, a resin material. A first tilting member 55 and a second tilting member 57 are attached to the bracket 50. The first tilting member 55 includes an aiming screw 55*a* attached to the lamp body 11, a screw connection unit 55*b* provided in the bracket 50 of the first tilting member 55, and an adjustment unit 55*c* disposed outside the lamp body 11. One end side of the aiming screw 55*a* is inserted into the screw connection unit 55*b*, and the other end side thereof is connected to the adjustment unit 55*c*. The second tiling member 57 includes a ball joint 57*a* attached to the lamp body 11, a socket 57*b* that holds the ball of the ball joint 57*a*, and a hole 57*c* provided in the bracket 50 of the second tilting member 57. The socket 57*b* is inserted into the hole 57*c*. In the present exemplary embodiment, the aiming mechanism is connected to the bracket 50. However, the exemplary embodiment is not limited particularly to the configuration. For example, the aiming mechanism may be connected directly to the lamp unit 100 without requiring the brackets 50.

When the aiming screw 55*a* is rotated through the adjustment unit 55*c* of the first tiling member 55, the bracket 50 is tilted with respect to the lamp body 11 around the ball of the ball joint 57*a* of the second tiling member 57 as a fulcrum. In this way, the optical axis of the lamp unit 100 may be adjusted.

The lamp unit 100 includes a substrate 110, a reflector 130, a heat dissipating member 150, and a fastening member 170. The lamp unit 100 of the present exemplary embodiment is a so-called parabola-type lamp unit.

The substrate 110 is a substantially plate shaped member that supports a light source 114. The substrate 110 includes a light source mounting surface 112, and the light source 114 is mounted on the light source mounting surface 112. The light source 114 is, for example, a light emitting diode (LED). In the present exemplary embodiment, the main surface of the substrate 110 which faces vertically downward is the light source mounting surface 112. The light source 114 is mounted on the light source mounting surface 112 such that a light emitting surface thereof faces vertically downward. The light source mounting surface 112 is provided with a wiring pattern (not illustrated) to which the light source 114 is electrically connected. In the present exemplary embodiment, the posture of the lamp unit 100 is set such that the light emitting surface of the light source 114 faces vertically downward. However, the posture of the lamp unit 100 is not limited to this configuration. For example, the posture of the lamp unit 100 may be set such that the normal line of the light emitting surface of the light source 114 is in parallel with the horizontal surface. For example, the lamp unit 100 may take a posture of being rotated 90 degrees around the optical axis from the state illustrated in FIG. 1 such that the light emitting surface of the light source 114 faces the side of the lamp unit. Alternatively, the posture of the lamp unit 100 may be set such that the light emitting surface of the light source 114 faces vertically upward. The installation angle of the lamp unit 100 may be appropriately selected.

In addition, the substrate 100 includes a first opening 116 in an area overlapping with a boss portion 136 to be described later in the stacking direction A of the reflector 130, the substrate 110, and the heat dissipating member 150 (in the direction represented by arrow A in FIGS. 1 and 2).

The reflector 130 is disposed at the light source mounting surface 112 side of the substrate 110. The reflector 130 includes a flat-plate-shaped base portion 132 that abuts to the substrate 110, and a reflecting portion 134 that extends from the end of the base portion 132 at the rear side of the vehicle toward the front side of the vehicle while being curved downward. The base portion 132 includes a light source opening 132*a* in an area overlapping with the light source 114. The reflecting portion 134 includes a reflecting surface 134*a* that reflects light emitted from the light source 114 mounted on the light source mounting surface 112 toward the front side of the lamp.

The reflecting surface 134*a* is formed based on a shape of, for example, a rotating parabolic surface of which the rotating central axis is the optical axis of the reflector 130. The reflector 130 is disposed such that the optical axis thereof extends in the front-and-rear direction of the vehicle. The light source 114 is disposed within the light source opening 132*a* such that the light emitting surface thereof is substantially opposite to the reflecting surface 134*a*. The mutual positional relationship between the light source 114 and the reflecting surface 134*a* is set such that a focal point of the reflecting surface 134*a* overlaps with the light source 114.

The reflector 130 also includes the boss portion 136. The boss portion 136 is provided on the surface of the base portion 132 which is in contact with the substrate 110 and protrudes toward the heat dissipating member 150 side. The boss portion 136 includes a fastening hole 136*a* for the fastening member 170. The reflector 130 is formed by performing an aluminum deposition on an area of, for example, a resin-molded substrate which corresponds to at least the reflecting surface 134*a*.

The heat dissipating member 150 is formed by, for example, an aluminum plate and has a function to dissipate heat generated from the light source 114. By providing the heat dissipating member 150, the dissipation performance of heat from the light source 114 may be improved. The heat dissipating member 150 is disposed on the surface of the substrate 110 at the side opposite to the light source mounting surface 112. The heat dissipating member 150 includes a first portion 152, a second portion 154, and a connecting portion 156.

The first portion 152 has a flat plate shape and is in contact with the substrate 110 to be thermally conductive with the substrate 110. In the present exemplary embodiment, the first portion 152 and the substrate 110 are in contact with each other through a heat transfer sheet 158 which has an insulating property and flexibility or elasticity. The heat transfer sheet 158 is provided in an area overlapping with at least the light source 114 in the stacking direction A. The heat transfer sheet 158 is interposed between the substrate 110 and the first portion 152 so that the heat transfer between the substrate 110 and the heat dissipating member 150 may be more reliably ensured, thereby further improving the dissipation performance of heat from the light source 114. The first portion 152 and the substrate 110 may be in direct contact with each other. Without being limited to the heat transfer sheet 158, a thermal interface material (TIM) such as, for example, a thermal conductive grease or a thermal conductive adhesive may be interposed between the first portion 152 and the substrate 110.

The first portion 152 includes a second opening 152*a* in an area overlapping with the boss portion 136 in the stacking direction A.

The second portion 154 is disposed in a position overlapping with the second opening 152*a* in the stacking direction A. The second portion 154 is more spaced apart from the reflector 130 than the first portion 152. The second portion 154 includes an insertion hole 154*a* for the fastening member 170 and a fastening seat surface 154*b* disposed around the insertion hole 154*a*. The second portion 154 extends in parallel with, for example, the first portion 152.

The connecting portion 156 connects the first portion 152 and the second portion 154 to each other. One end side of the connecting portion 156 is connected to the first portion 152. Then, the connecting portion 156 extends vertically upward or in a direction separated from the substrate 110 or the reflector 130 from the first portion 152 such that the other end side of the connecting portion 156 is connected to the second portion 154.

The heat dissipating member 150 includes a small width portion T having a relatively small width and a large width portion W having a relatively large width, in an area ranging from an end 156*a* of the connecting portion 156 which is in contact with the first portion 152 to the insertion hole 154*a* of the second portion 154. The width N of the small width portion T is smaller than the width M of the large width portion W, and the width M of the large width portion W is larger than the width N of the small width portion T. The range of the area where the small width portion T and the large width portion W are provided is, for example, from the end 156*a* to the end of the insertion hole 154 which is closest to the connecting portion 156. In the present exemplary embodiment, the small width portion T is provided in the area ranging from the end 156*a* of the connecting portion 156 to a midway of the connecting portion 156, and the rest of the connecting portion 156 and the second portion 154 form the large width portion W.

Here, the "width" of the small width portion T and the large width portion W refers to a dimension in a direction orthogonal to the extending direction of the member provided with the small width portion T or the large width portion W. In the present exemplary embodiment, the width of the small width portion T refers to the length of the area of the connecting portion 156 where the small width portion T is provided, in the direction orthogonal to the extending direction of the connecting portion 156. Further, the width of the large width portion W refers to the length of the area 156*b* in the direction orthogonal to the extending direction of the connecting portion 156, and the length of the second portion 154 in the direction orthogonal to the extending direction of the second portion 154. The extending direction of the connecting portion 156 refers to the direction in which, for example, the end 156*a* of the connecting portion 156 and the end thereof which is in contact with the second portion 154 are arranged. The extending direction of the second portion 154 refers to the direction in which, for example, the end of the second portion 154 which is in contact with the connecting portion 156 and the insertion hole 154*a* are arranged.

In other words, the connecting portion 156 has a portion in which the opposite sides of the connecting portion 156 become distant from each other stepwise toward the end side of the connecting portion 156 which is in contact with the second portion 154 from the end 156*a* side. In the present exemplary embodiment, the opposite sides become distant from each other single-stepwise, but may become distant from each other multi-stepwise. Further, the distance between the opposite sides may increase continuously. Further, the connecting portion 156 may have a portion in which opposite sides of the connecting portion 156 become close to each other stepwise or continuously toward the end side of the connecting portion 156 which is in contact with the second portion 154 from the end 156*a* side. In this case, the small width portion T is provided in a position spaced apart from the end 156*a*.

In addition, the area of the cross section of the small width portion T which is orthogonal to the extending direction of the member provided with the small width portion T is smaller than the area of the cross section of the large width portion W which is orthogonal to the extending direction of the member provided with the large width portion W. In addition, for example, the width N of the small width portion T is narrower than the width of the area of the fastening seat surface 1 Mb on which the head of the fastening member 170 contacts. Further, the small width portion T and the large width portion W may adopt various shapes and arrangements as also described in modifications to be described later.

The heat dissipating member 150 may be formed by providing a notch along the shapes of the second portion 154 and the connecting portion 156 at a predetermined position of, for example, an aluminum plate and cutting off the internal portion of the notch. The cut-off portion of the aluminum plate becomes the second portion 154 and the connecting portion 156, and the rest thereof becomes the first portion 152.

The fastening member 170 is configured to fix the substrate 110, the heat dissipating member 150, and the reflector 130 to each other. The fastening member 170 is, for example, a screw. As illustrated in FIG. 2, the substrate 110 and the heat dissipating member 150 are disposed on the base portion 132 of the reflector 130. In this case, the boss portion 136, the first opening 116, and the second opening 152*a* are positioned so as to overlap with each other in the stacking direction A. Then, the substrate 110 and the heat dissipating member 150 are stacked on the base portion 132.

As a result, as illustrated in FIG. 1, the boss portion 136 passes through the first opening 116 and the second opening 152*a* and abuts to the second portion 154 such that the fastening hole 136*a* and the insertion hole 154*a* overlap with each other in the stacking direction A. In this state, the fastening member 170 is inserted into and passes through the insertion hole 154*a* so as to be fastened into the fastening hole 136*a*. When the fastening member 170 is a screw, the fastening member 170 is screw-coupled to the fastening hole 136*a*. The head of the fastening member 170 abuts on the fastening seat surface 154*b*. In this way, the substrate 110, the reflector 130, and the heat dissipating member 150 may be fixed to each other.

As described above, the lamp unit 100 as the vehicle lamp according to the present exemplary embodiment includes the substrate 110, the reflector 130, the heat dissipating member 150, and the fastening member 170. The reflector 130 includes the boss portion 136 that protrudes toward the heat dissipating member 150 side and has the fastening hole 136*a*. The substrate 110 includes the first opening 116 through which the boss portion 136 passes. The heat dissipating member 150 includes the first portion 152 that includes the second opening 152*a* through which the boss portion 136 passes, the second portion 154 that is disposed at the upper side than the first portion to include the insertion hole 154*a* and the fastening seat surface 154*b*, and the connecting portion 156 that connects the first portion 152 and the second portion 154 to each other. The boss portion 136 protrudes toward the heat dissipating member 150 side such that the front end thereof abuts to the second portion 154. In this state, the fastening member 170 is inserted into and passes through the insertion hole 154*a* so that the substrate 110, the reflector 130, and the heat dissipating member 150 are fixed to each other.

In a conventional structure of fixing a substrate, a heat dissipating member, and a reflector to each other by using a fastening member, a boss portion provided in the reflector protrudes toward a reflecting surface side. The boss portion is required to have a predetermined height in order to secure a depth of a fastening hole into which the fastening member is engaged. Hence, in the conventional structure, the boss portion may overlap with a light path of light emitted from a light source, in particular, a light path in which light reflected on the reflecting surface travels toward the front side of the lamp. In this case, the traveling of the light toward the front side of the lamp is disturbed by the boss portion, thereby reducing a light quantity of the vehicle lamp.

The overlapping between the boss portion and the light path of light emitted from the light source may be avoided by spacing the substrate and the reflector apart from each other and disposing the boss portion to protrude toward the substrate side such that the boss portion is accommodated in the space between the substrate and the reflector. However, when the substrate and the reflector are spaced apart from each other, a solid angle of a light flux incident on the reflecting surface of the reflector from a light source is reduced. That is, among light emitted from the light source, a quantity of light that can reach the reflecting surface of the reflector is reduced. As a result, the light quantity of the vehicle lamp is reduced.

In the present exemplary embodiment, the boss portion 136 protrudes toward the substrate 110 side and is inserted into and passes through the first opening 116 of the substrate 110 and the second opening 152*a* of the heat dissipating member 150. Accordingly, since the space for accommodating the boss portion 136 may not be provided between the substrate 110 and the reflector 130, the substrate 110 and the reflector 130 may be positioned close to each other. Thus, it is possible to avoid that the boss portion 136 and the light path of light emitted from the light source overlap with each other and also avoid that the solid angle of the incident light flux is reduced. As a result, the light quantity of the vehicle lamp may be increased.

In addition, the heat dissipating member 150 includes the small width portion T and the large width portion W in the range from the end 156*a* of the connecting portion 156 which is in contact with the first portion 152 to the insertion hole 154*a* of the second portion 154. As the two areas having different widths are provided, the small width portion T having a relatively small width naturally becomes a fragile portion compared to the large width portion W having a relatively large width. Hence, the small width portion T is deformed by the stress generated when the fastening member 170 is fastened. Accordingly, the small width portion T is able to absorb the stress generated when the fastening member 170 is fastened. Further, since the stress may be absorbed by the small width portion T, it is possible to avoid that the substrate 110 is distorted by the stress generated at the time of the fastening thereby causing a positional deviation of the light source 114. As a result, it is possible to suppress the accuracy in the formation of a light distribution pattern by the lamp unit 100 from being deteriorated.

The present disclosure is not limited to the above-described exemplary embodiment. Further modifications (e.g., various design modifications) may be made to the present disclosure based on the knowledge of a person ordinarily skilled in the art. The scope of the present disclosure also includes exemplary embodiments to which the modifications are applied. An exemplary embodiment which is newly made by a combination of the above-described exemplary embodiment and a modification exhibits an effect of each of the exemplary embodiment and the modification to be combined with each other.

In the above-described exemplary embodiment, the small width portion T is provided in a part of the connecting portion 156, and the large width portion W is provided in the remaining part of the connecting portion 156 and the second portion 154. However, the dispositions and the shapes of the small width portion T and the large width portion W are not limited to those described in the above-described exemplary embodiment. For example, the small width portion T may be provided in a part of the area ranging from the end of the second portion 154 which is in contact with the connecting portion 156 to the insertion hole 154*a*, and the large width portion W may be provided in the rest of the second portion 154 and the connecting portion 156.

In addition, as the dispositions and the shapes of the small width portion T and the large width portion W, for example, Modifications 1 to 4 may be exemplified as described below.

Modification 1

Figure 3A:
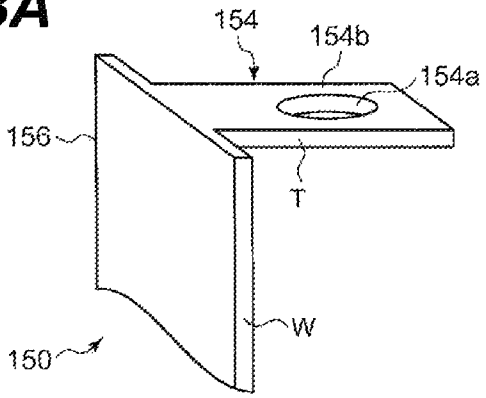
FIG. 3A is a perspective view schematically illustrating a small width portion and a large width portion in a vehicle lamp according to Modification 1.

FIG. 3A is a perspective view schematically illustrating a small width portion and a large width portion in a vehicle lamp according to Modification 1. As illustrated in FIG. 3A, in the heat dissipating member 150 of Modification 1, the small width portion T is provided in the second portion 154, and the large width portion W is provided in the connecting portion 156. In Modification 1, the entire second portion 154 constitutes the small width portion T, and the entire connecting portion 156 constitutes the large width portion W. In other words, in the present modification, the distance between the opposite sides changes at the connected portion between the connecting portion 156 and the second portion 154. In this case as well, the stress generated at the time of the fastening of the fastening member 170 may be absorbed by the small width portion T. Further, the entire connecting portion 156 may constitute the small width portion T, and the entire second portion 154 may constitute the large width portion W.

Modification 2

Figure 3B:
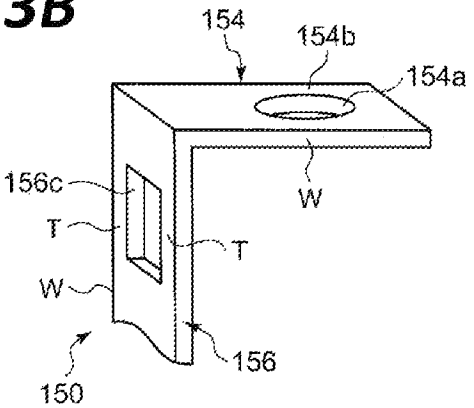
FIG. 3B is a perspective view schematically illustrating a small width portion and a large width portion in a vehicle lamp according to Modification 2.

FIG. 3B is a perspective view schematically illustrating a small width portion and a large width portion in a vehicle lamp according to Modification 2. As illustrated in FIG. 3B, in Modification 2, a small width portion T is formed in the connecting portion 156 by providing an opening 156*c* in the connecting portion 156. In the present modification, the small width portion T corresponds to a frame portion of the opening 156*c*. Accordingly, the connecting portion 156 includes two small width portions T, and the large width portion W of the insertion hole 154*a* side and the large width portion W of the first portion 152 side are connected to each other by the two small width portions T. In this case as well, the stress generated at the time of the fastening of the fastening member 170 may be absorbed by the small width portions T. In addition, the small width portion T may be formed by providing an opening in the area ranging from the end of the second portion 154 which is in contact with the connecting portion 156 to the insertion hole 154*a*. In addition, the opening 156*c* provided in the connecting portion 156 and the opening provided in the second portion 154 may be continuous to each other so as to become one opening. That is, an opening may be provided in the area where the connecting portion 156 and the second portion 154 are in contact with each other.

Modification 3

Figure 3C:
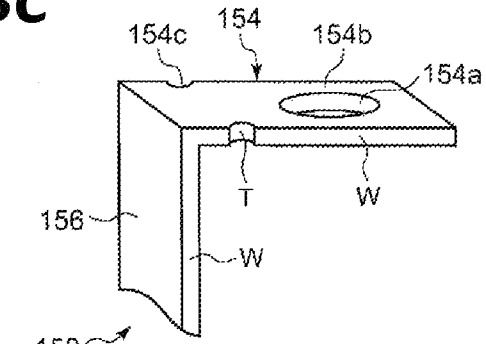
FIG. 3C is a perspective view schematically illustrating a small width portion and a large width portion in a vehicle lamp according to Modification 3.

FIG. 3C is a perspective view schematically illustrating a small width portion and a large width portion in a vehicle lamp according to Modification 3. As illustrated in FIG. 3C, in Modification 3, a small width portion T is formed in the second portion 154 by providing a notch 154*c* in the second portion 154. In the present modification, the small width portion T refers to a locally constricted portion which has a small width in the second portion 154. In other words, the second portion 154 of the present modification has an area in which the opposite sides thereof become close to each other stepwise or continuously toward the insertion hole 154*a* side from the end side of the second portion 154 which is in contact with the connecting portion 156, and then, become distant from each other stepwise or continuously. In this case as well, the stress generated at the time of the fastening of the fastening member 170 may be absorbed by the small width portions T.

Modification 4

Figure 3D:
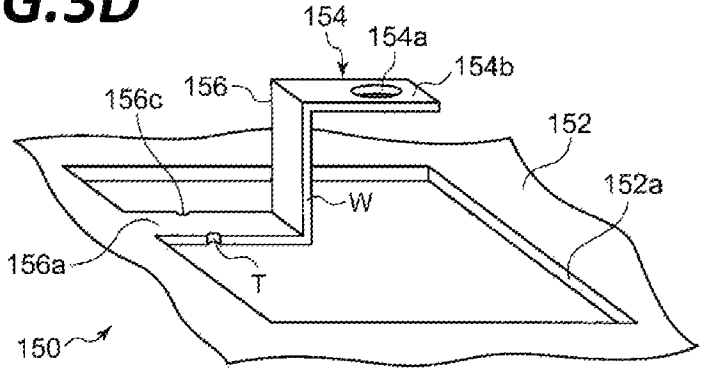
FIG. 3D is a perspective view schematically illustrating a small width portion and a large width portion in a vehicle lamp according to Modification 4.

FIG. 3D is a perspective view schematically illustrating a small width portion and a large width portion in a vehicle lamp according to Modification 4. As illustrated in FIG. 3D, in Modification 4, a small width portion T is formed in the connecting portion 156 by providing a notch 156*d* in the connecting portion 156. In the present modification, the small width portion T refers to a locally constricted portion which has a small width in the connecting portion 156. In other words, the connecting portion 156 of the present modification has an area in which the opposite sides thereof become close to each other stepwise or continuously toward the end side of the connecting portion 156 which is in contact with the second portion 154 from the end 156*a* side, and then, become distant from each other stepwise or continuously. In this case as well, the stress generated at the time of the fastening of the fastening member 170 may be absorbed by the small width portions T. In addition, the connecting portion 156 of the present modification includes a portion that extends in parallel with the first portion 152 from the second opening 152*a*, and a portion that extends from the front end of the portion extending in parallel with the first portion 152 to be spaced apart from the first portion 152 and connected to the second portion 154.

Other Modifications

In the above-described exemplary embodiment, an LED is exemplified as the light source 114. However, the light source 114 is not limited to the LED, but may be, for example, a semiconductor laser or a valve lamp. In addition, a parabola-type lamp unit is exemplified as the lamp unit 100. However, the lamp unit 100 may be a projector-type lamp unit or a lamp unit of a polarized electron source (PES) optical system.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A vehicle lamp comprising:

a substrate having a light source mounting surface, a heat dissipating member disposed on a surface of the substrate at a side opposite to the light source mounting surface, a reflector disposed at the light source mounting surface side of the substrate to reflect light emitted from a light source mounted on the light source mounting surface, and a fastening member configured to fix the substrate, the heat dissipating member, and the reflector to each other, wherein the reflector includes a boss portion that protrudes toward the heat dissipating member side and includes a fastening hole for the fastening member, the substrate includes a first opening in an area overlapping with the boss portion in a stacking direction of the reflector, the substrate, and the heat dissipating member, the heat dissipating member is in contact with the substrate to be thermally conductive with the substrate and includes a first portion that includes a second opening in an area overlapping with the boss portion in the stacking direction, a second portion that overlaps with the second opening in the stacking direction and is more spaced apart from the reflector than the first portion to include an insertion hole for the fastening member and a fastening seat surface, and a connecting portion that connects the first portion and the second portion to each other, and the boss portion passes through the first opening and the second opening and abuts to the second portion such that the fastening hole and the insertion hole overlap with each other in the stacking direction.

2. The vehicle lamp of claim 1, wherein the heat dissipating member includes a small width portion having a relatively small width and a large width portion having a relatively large width in an area ranging from the end of the connecting portion which is in contact with the first portion to the insertion hole of the second portion.

* * * * *